US006755166B2

(12) United States Patent
Chang et al.

(10) Patent No.: US 6,755,166 B2
(45) Date of Patent: Jun. 29, 2004

(54) ELECTROMECHANICAL VALVE DRIVE INCORPORATING A NONLINEAR MECHANICAL TRANSFORMER

(75) Inventors: Woo Sok Chang, Lexington, MA (US); Thomas A. Keim, Boxborough, MA (US); John G. Kassakian, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/245,453

(22) Filed: Sep. 17, 2002

(65) Prior Publication Data

US 2003/0051688 A1 Mar. 20, 2003

Related U.S. Application Data

(60) Provisional application No. 60/322,813, filed on Sep. 17, 2001.

(51) Int. Cl.[7] ..... F01L 1/30

(52) U.S. Cl. ..... 123/90.26; 123/90.24; 123/90.15; 123/90.11; 251/129.07; 251/129.11; 74/838

(58) Field of Search ..... 123/90.11, 90.16, 123/90.24, 90.26, 90.65, 90.66; 251/129.07, 129.11, 129.15; 336/115, 117, 119; 74/53–60, 831–839, 567, 568 R, 569

(56) References Cited

U.S. PATENT DOCUMENTS

| | | | | |
|---|---|---|---|---|
| 4,831,973 A | * | 5/1989 | Richeson, Jr. | 123/90.11 |
| 4,883,025 A | * | 11/1989 | Richeson, Jr. | 123/90.11 |
| 5,211,372 A | | 5/1993 | Smith, Jr. | 251/75 |
| 5,245,957 A | | 9/1993 | Bornstein et al. | 123/90.26 |
| 5,327,856 A | | 7/1994 | Schroeder et al. | 123/90.11 |
| 5,494,007 A | | 2/1996 | Schroeder et al. | 123/90.11 |
| 5,598,814 A | | 2/1997 | Schroeder et al. | 123/90.11 |
| 5,772,179 A | * | 6/1998 | Morinigo et al. | 251/129.1 |
| 5,873,335 A | | 2/1999 | Wright et al. | 123/90.11 |
| 6,176,208 B1 | | 1/2001 | Tsuzuki et al. | 123/90.11 |
| 6,390,079 B1 | * | 5/2002 | Gagnon et al. | 123/568.23 |

FOREIGN PATENT DOCUMENTS

JP 152820 A 5/2001

OTHER PUBLICATIONS

PCT International Search Report from PCT/US02/29359.

Rassem R. Henry, Single–Cylinder Engine Tests of a Motor–Driven, Variable–Valve Actuator, Delphi Research Labs, 2001, 10 pages.

Rassem R. Henry et al., "A Novel, Fully Flexible, Electro–Mechanical Engine Valve Actuation System", General Motors Research and Development Center, 1997, 10 pages.

Mark A. Theobald et al., "Control of Engine Load via Electromagnetic Valve Actuators", General Motors North American Operations Research and Development Center, 1994, 14 pages.

* cited by examiner

*Primary Examiner*—Thomas Denion
*Assistant Examiner*—Kyle Riddle
(74) *Attorney, Agent, or Firm*—Daly, Crowley & Mofford, LLP

(57) ABSTRACT

The present invention provides a means to reduce holding current and driving current of EMVD's effectively and practically and to provide soft landing of a valve. The invention incorporates a nonlinear mechanical transformer as part of an EMVD system. The nonlinear mechanical transformer is designed for the spring and the inertia in the EMVD to have desirable nonlinear characteristics. With the presently disclosed invention, the holding current and driving current are reduced and soft valve landing is achieved. The nonlinear characteristics of a nonlinear mechanical transformer can be implemented in various ways. The concept of the invention can be applied not only to EMVD's but also to general reciprocating and bi-stable servomechanical systems, where smooth acceleration, soft landing, and small power consumption are desired.

20 Claims, 18 Drawing Sheets

(a)

1. Before

2. After partial lift

ELECTROMECHANICAL VALVE DRIVE INCORPORATING A NONLINEAR MECHANICAL TRANSFORMER

CROSS REFERENCE TO RELATED APPLICATIONS

This application claims priority under 35 U.S.C. §119(e) to Provisional Patent Application No. 60/322,813 filed on Sep. 17, 2001, the disclosure of which is hereby incorporated by reference.

STATEMENT REGARDING FEDERALLY SPONSORED RESEARCH

Not Applicable

FIELD OF THE INVENTION

The present invention relates generally to electromechanical valve drive systems, and more specifically to an electromechanical valve drive system incorporating a nonlinear mechanical transformer.

BACKGROUND OF THE INVENTION

Traditional internal combustion (IC) engines are well known. In an IC engine, a camshaft (also referred to as simply a cam) acts on the valve stems of valves to open and close the valves. The timing of the valves' openings and closings is controlled by the cam design and is fixed relative to piston position since the cam is physically coupled to and driven by the crankshaft. Due to this fixed relationship between the camshaft and crankshaft, the valve timing in IC engines is designed optimally at one speed and load, usually, at high speed and wide-open throttle conditions.

Alternates to IC engines are also known. One such alternative is a variable valve actuation (VVA) system in which significant improvements in fuel efficiency, engine performance, emission, and idle quality has been achieved. One of the most advanced VVA systems demonstrated to date is the BPVD (bi-positional electromechanical valve drive), which can offer cylinder deactivation, as well as duration and phase control functions, without a camshaft. Such a BPVD VVA assembly comprises a valve or valves, one or more springs, and an electromechanical actuator. In a particular BPVD, two solenoids are used as the electromechanical actuator. The spring (or system of springs) is disposed such that the zero-force position for the springs is at the midpoint of the valve stroke. The acceleration curve in BPVD systems has a relatively large (theoretically infinite) time rate of change of acceleration (referred to as "jerk") at both ends of the stroke which provides a harsh landing of the valve at the end of the stroke. This is one of the reasons why the idealized prior BPVD must be modified or intensively controlled to achieve a soft landing.

Even the best prior art EMVD's are very noisy due at least in part to the large jerk at both ends of the stroke. In order to reduce the large jerk associated with the prior EMVD and to reject external disturbances, active feedback control is implemented. However, in prior EMVDs with active feedback control, there are two critical problems. The solenoid actuators (which are a member of the class of normal-force electromagnetic actuators, in which the force acts normal to the air gap surface) have the property that the force of a given actuator is unidirectional. Thus to provide a bi-directional force capability, two oppositely directed actuators are required. Solenoid actuators also have the property that the force coefficient (force per unit current) falls off rapidly as air gap increases. As the valve approaches its intended resting place at the end of a stroke, the near actuator can easily provide a large force to draw the valve to its resting place. It is difficult not to apply too much force, contributing to a hard landing. If at any point in the transition too much force in the direction of motion has been applied, the valve will approach the end of stroke too fast, and will collide forcefully with the stop at the end of the stroke. The actuator which is capable of supplying force in the direction to slow the valve near the end of stroke must act with a large air gap. That actuator will have a small force coefficient and may be unable to apply enough retarding force, even with high current. Once the valve has come to rest, the normal force actuator which holds it at rest works with a small air gap. It can therefore hold the valve at rest with a low current.

For ease of control, a shear force actuator is much to be preferred. These actuators are bidirectional, so the same actuator can provide force in either direction. They are commonly produced with a force coefficient which does not vary as a function of the position of the valve. This linearizes and simplifies the control problem. But simple substitution of a shear force actuator for the solenoids in existing BPVD's is not the answer. The holding current to maintain the valve at both ends of the stroke is undesirably high and the concomitant power loss is high as well. Additionally, the driving current is too large to be acceptable in practice.

It would, therefore, be desirable to provide an EMVD control system having a relatively low holding current and a relatively low driving current. It would be further desirable to provide an EMVD having a relatively low holding current and a relatively low driving current while also having smooth acceleration, soft valve landing, and reduced power consumption characteristics.

SUMMARY OF THE INVENTION

In accordance with the present invention, a valve drive system includes a nonlinear mechanical transformer having a motor coupled thereto. In accordance with the present invention, a valve drive system includes a nonlinear mechanical transformer having a first end coupled to a portion of the system and having a second end adapted to couple to a valve. The system further includes a motor which can be electrically controlled to drive the nonlinear mechanical transformer at different speeds independently of the engine cycle. This allows the drive system to provide fully variable valve actuation functions. Accordingly, the valve drive system of the present invention corresponds to an electromechanical valve drive (EMVD) variable valve actuation (VVA) system. Since the motor drives a nonlinear mechanical transformer, a valve drive system having a relatively low holding current and a relatively low drive current is provided. The present invention thus provides reduced holding current and driving current of an EMVD in an effective and practical manner. The present invention achieves the reduced holding current and driving current by incorporating a nonlinear mechanical transformer as part of the EMVD system. The nonlinear mechanical transformer is designed for the spring and the inertia in the EMVD to have desirable nonlinear characteristics.

In one embodiment, a spring or a system of springs is disposed about the nonlinear mechanical transformer. The nonlinear mechanical transformer is designed for the spring and the inertia in the EMVD to the value with desirable characteristics. The nonlinear characteristics of a nonlinear mechanical transformer can be implemented in various ways. Additional embodiments include an inherently nonlinear spring. The nonlinear spring may be in the form of a disk spring. The concept of using a nonlinear mechanical transformer can be applied not only to EMVD's but also to general reciprocating and bi-positional servomechanical systems, where smooth acceleration, soft landing, and small power consumption are desired.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
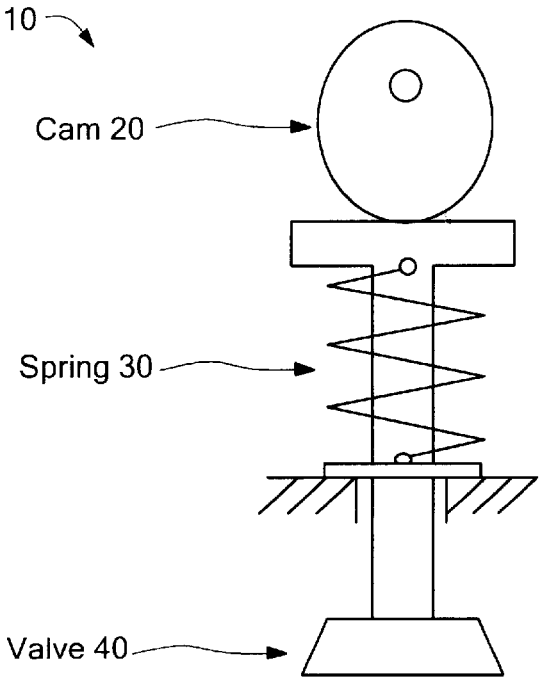
Prior Art FIG. 1
FIG. 1 is a diagram of a prior art valve assembly of an internal combustion engine.

A conventional valve drive for an internal combustion engine is shown in FIG. 1. The valve drive 10 incorporates a lobed cam 20 that drives a valve 40. A spring 30 is used to bias the valve against the lobe of the cam. The cycle rate of the valve drive is directly related to speed of the engine, as typically the cam is mechanically connected to a crankshaft that drives the piston of the engine. Since the cam is mechanically connected to the crankshaft by way of a timing chain, timing belt or timing gears, the cycle time or stroke of the valve is generally fixed relative to the cycle time of the engine itself.

Figure 2:
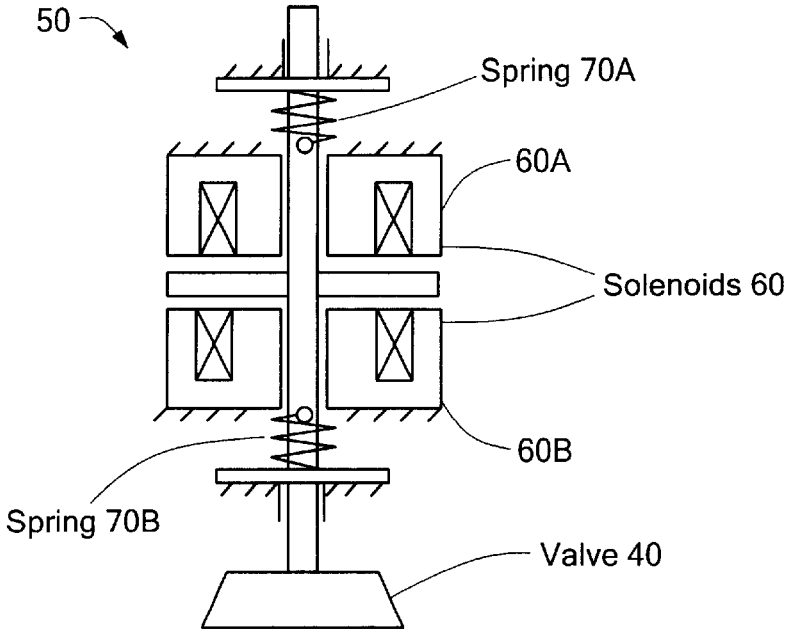
Prior Art FIG. 2
FIG. 2 is a diagram of a prior art electro-mechanical valve drive.

Referring now to FIG. 2, a prior art electromechanical valve drive (EMVD) 50 is shown. EMVD 50 incorporates a valve 40, a plurality of solenoids 60 and springs 70*a*, 70*b*. The EMVD of FIG. 2 operates as follows. The springs 70 are provided such that the springs provide approximately zero force to the valve when the valve is approximately at the midpoint between the open position and the closed position. Initially the valve is held at a non-equilibrium position at one end of the stroke by activating solenoid 60*a*. When the solenoid 60*a* is disengaged, the valve 40 travels past an equilibrium position until it reaches the other end of the stroke. The time taken by the valve 40 to travel from the upper position to a lower position is known as the transition time. Solenoid 60*b* is engaged to maintain the valve in this position at the second end of the stroke. After a predetermined period of time, known as the holding time, the solenoid 60*b* is disengaged and the valve 40 returns to its original starting position.

Springs 70*a*, 70*b* play an important role in the EMVD device. The operation of the EMVD described above requires a relatively large inertial power (mass multiplied by acceleration, multiplied by velocity). This inertial power is provided by springs 70. The power consumed in an EMVD system is limited to the mechanical and electrical loss in the EMVD system and to the power required to compensate for external disturbances such as the gas force acting on the valves. In these prior art EMVDs, the spring and the inertia of the valve have linear characteristics.

Figure 3:
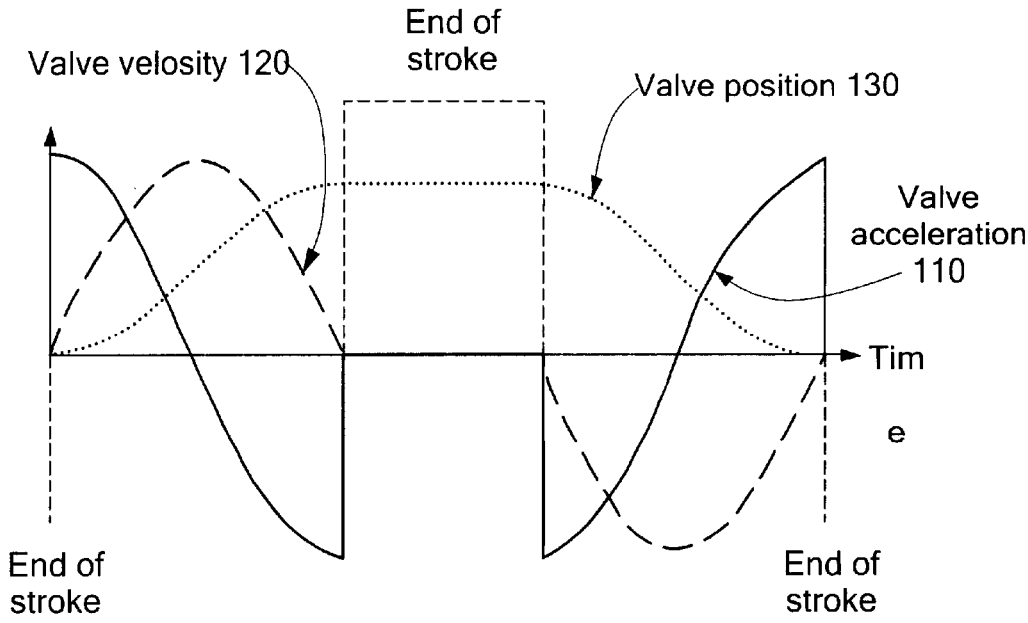
Prior Art FIG. 3
FIG. 3 is a diagram of the free flight dynamics of a prior art electro-mechanical valve drive assembly.
Figure 4:
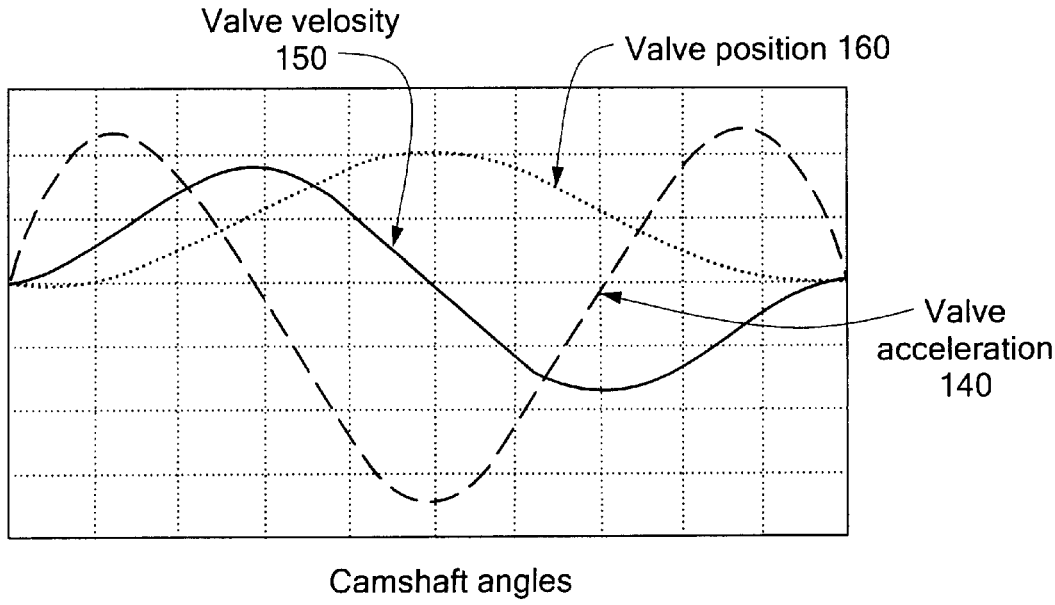
Prior Art FIG. 4
FIG. 4 is a diagram of the valve profile and its derivatives for a prior art internal combustion engine.

Referring now to FIG. 3, the free flight dynamics of the EMVD 50 of FIG. 2 is shown. Curve 130 corresponds to valve position, curve 120 corresponds to valve velocity and curve 110 corresponds to valve acceleration. The valve acceleration curve 110 has periods of infinite jerk at both ends of the stroke. This is in sharp contrast to the conventional IC valve train acceleration curve 140 shown in FIG. 4, which features a smooth acceleration curve. Note that the conventional IC valve train also has a smooth valve position curve 160 and a smooth valve velocity curve 150. Accordingly, due to these periods of infinite jerk in the valve acceleration 110 of the prior art EMVD valve assembly, the EMVD must be controlled to achieve a "soft" landing of the valve within the engine. In order to reduce or remove the large jerk associated with EMVD valve assemblies, active feedback control is used.

Figure 5:
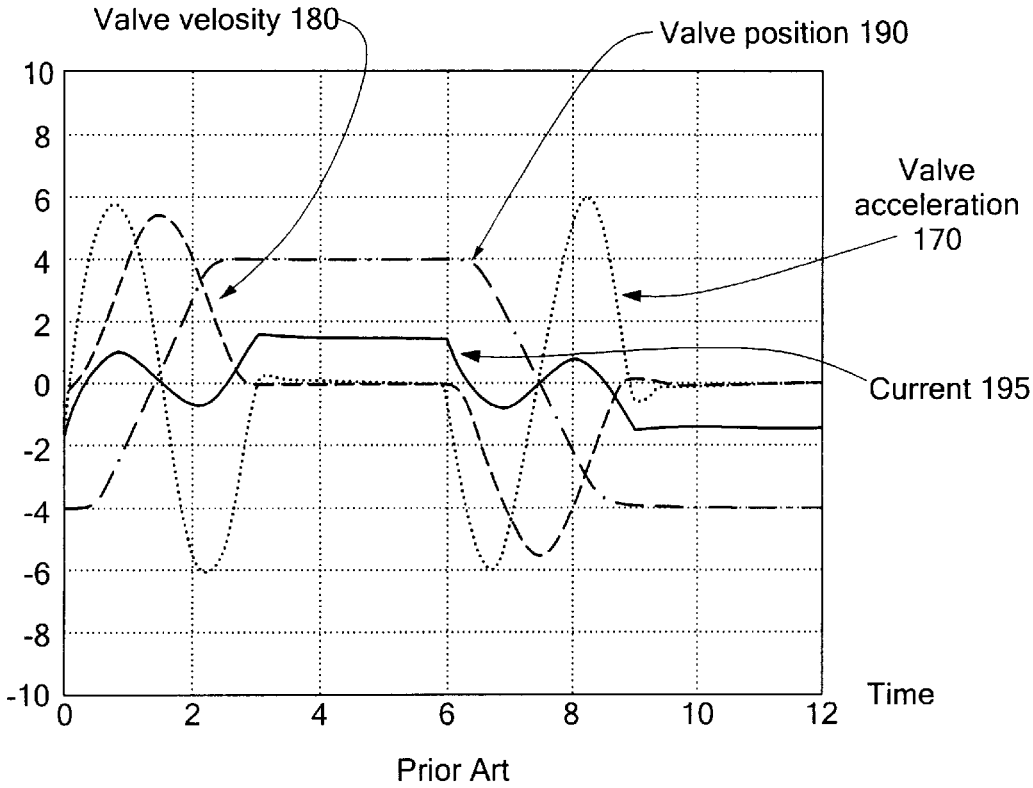
FIG. 5 is a diagram of the controlled dynamics of an electro-mechanical valve drive assembly including feedback control to achieve a reduced jerk profile.

Referring now to FIG. 5, the curves for a feedback controlled EMVD with a linear spring and linear inertia are shown. The curves in FIG. 5 correspond to a case where a linear electric motor, or a rotary electric motor with a uniform force or torque constant over the stroke (both examples of shear force actuators) is used instead of solenoid actuators. The valve position vs. time is feedback controlled to a desired reduced jerk profile. Valve acceleration is shown by curve 170, valve velocity is shown by curve 180, valve position is shown by curve 190 and current is shown by curve 195. As shown in the curves, the jerk is reduced, due to smooth kinematic inputs. Additionally, the effect of gas force is reduced by feedback control. It is not evident from FIG. 5, but the calculations which produced this figure also showed that the motor current, both during the valve transition time and during the holding period, are unacceptably large. FIG. 5 therefore shows that feedback control of a shear force actuator can eliminate the high-jerk characteristic of the prior-art EMVD, but that other features must be added to achieve acceptable motor currents.

Figure 6:
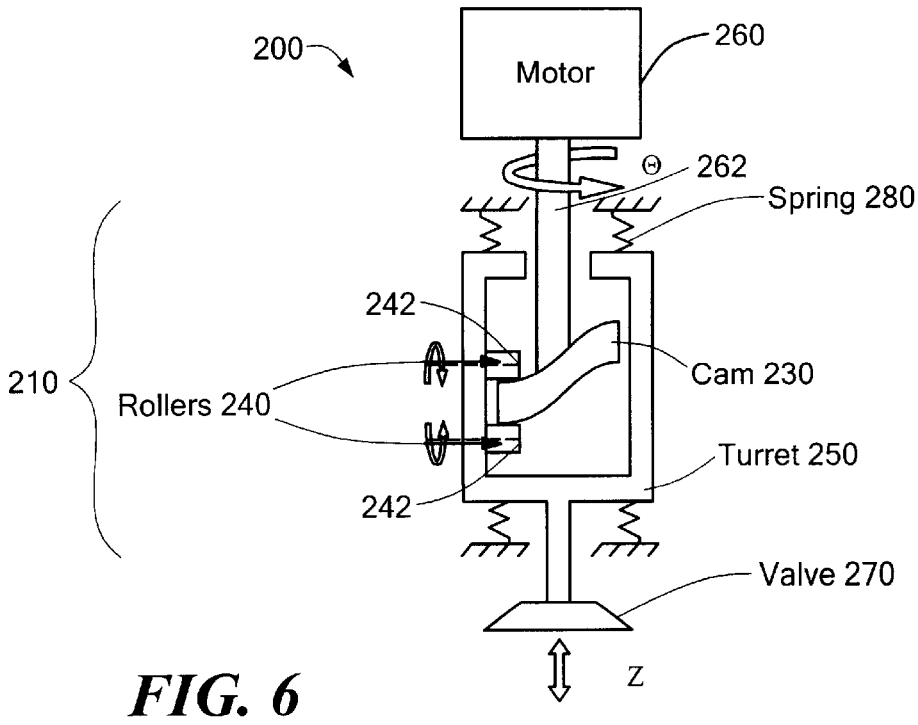
FIG. 6 is a diagram of an electro-mechanical valve drive assembly with nonlinear transformer of the present invention.

Referring now to FIG. 6, the present invention 200 is shown. In this embodiment the EMVD 200 incorporates a nonlinear mechanical transformer 210. A motor 260 is coupled through a member 262 to a rotary cam 230. The motor 260 turns the member 262, which in turn causes the cam 230 to rotate. Rollers 240 are free to rotate about their axes 242 and roll over first and second opposing surfaces of the rotary cam 230. The turret 250 is connected to the rollers 240 and the valve 270. The mechanism comprising the rotary cam 230, the rollers 240, and the turret 250 cooperate to function as a nonlinear mechanical transformer 210. The turret 250 and the valve 270 are free to move up and down and are constrained by a linear spring 280, but are fixed rotationally. With this nonlinear mechanical transformer 210, the stiffness or the inertia for vertical motion of the valve 270 or rotational motion of the motor 260 can be designed with substantial flexibility. The springs 280 are provided such that the springs provide approximately zero force to the valve when the valve is approximately at the midpoint between the open position and the closed position. With such an arrangement the majority of the work involved in moving the valve is performed by the springs. This results in a concomitant reduction in the holding and driving current required by the motor.

Figure 7:
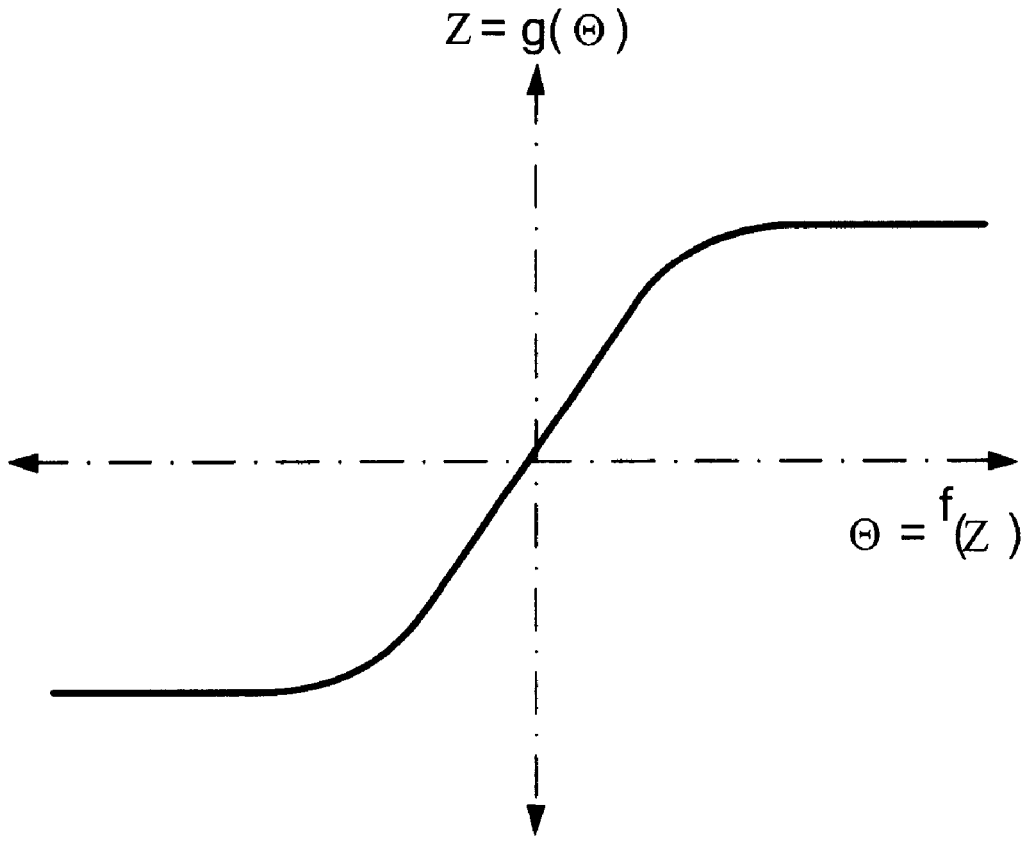
FIG. 7 is a graph showing a desired nonlinear relationship between rotational displacement of a motor and translation displacement of a valve in the present invention.

FIG. 7 shows a desirable relation between the rotational displacement of the motor and the translation displacement of the valve. With the characteristic of FIG. 7, both holding and driving current are reduced. The reflected force of the linear spring 280, resulting in a spring torque on the motor side, depends on the design of the nonlinear mechanical transformer 210. The mechanical holding force in the motor side can be reduced at both ends of the stroke of a valve if the slope ($dz/d\Theta$) of the mechanical transformer in FIG. 7 is almost flat at both ends of the stroke of a valve. Therefore, the holding current doesn't have to be large and power consumption is reduced. Also, since the effective moving inertia, viewed from the valve side, increases at both ends of the stroke due to the nonlinear transformer characteristic, the acceleration of the EMVD incorporating the nonlinear mechanical transformer is inherently smooth and small at the ends of the stroke. Therefore, the driving current for achieving smooth acceleration can be reduced passively, because the desired position-versus-time characteristic is created mechanically instead of electrically.

Figure 8:
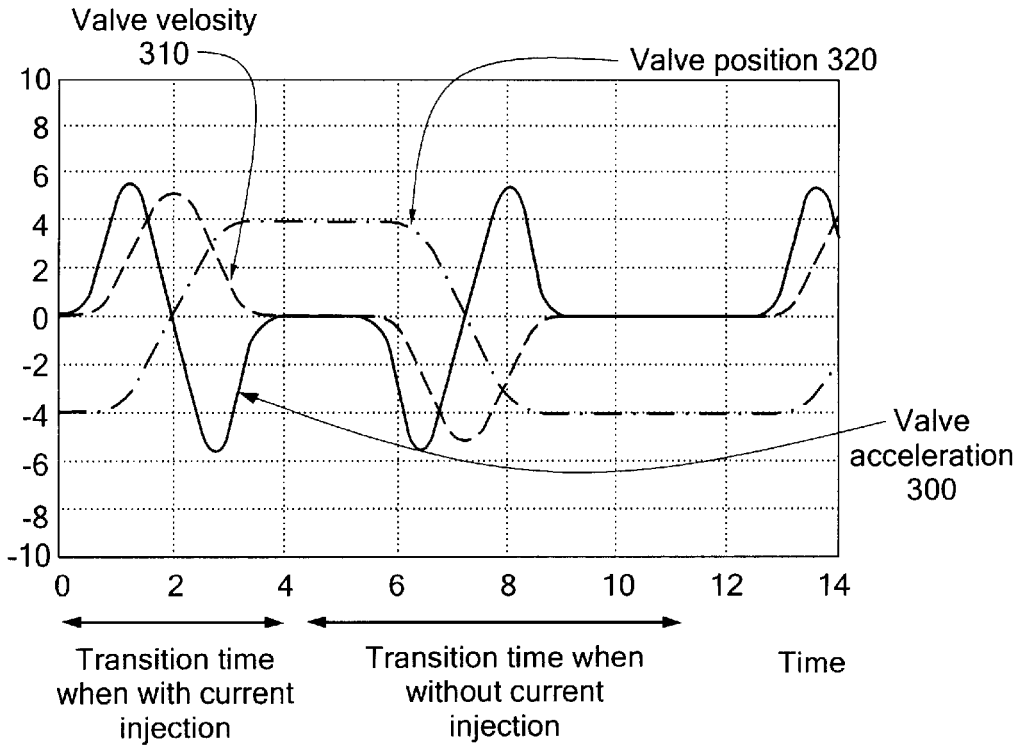
FIG. 8 is a diagram of the flight characteristics of the present invention with current injection and without current injection.
Figure 9:
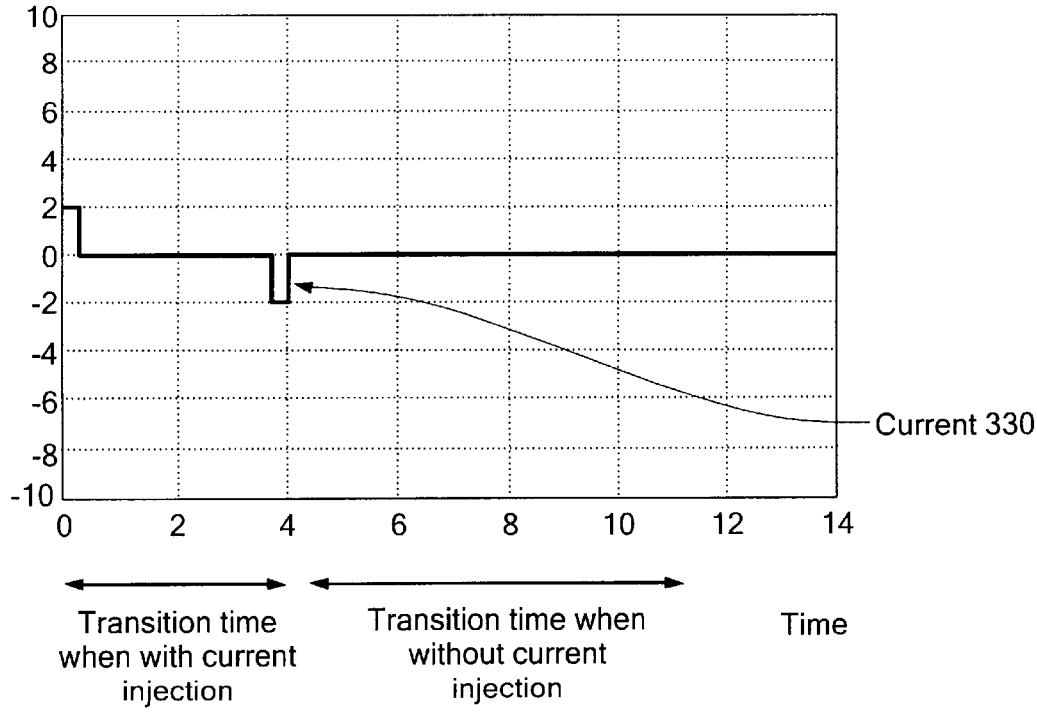
FIG. 9 is a diagram of the current associated with the flight characteristics of FIG. 8.
Figure 10:
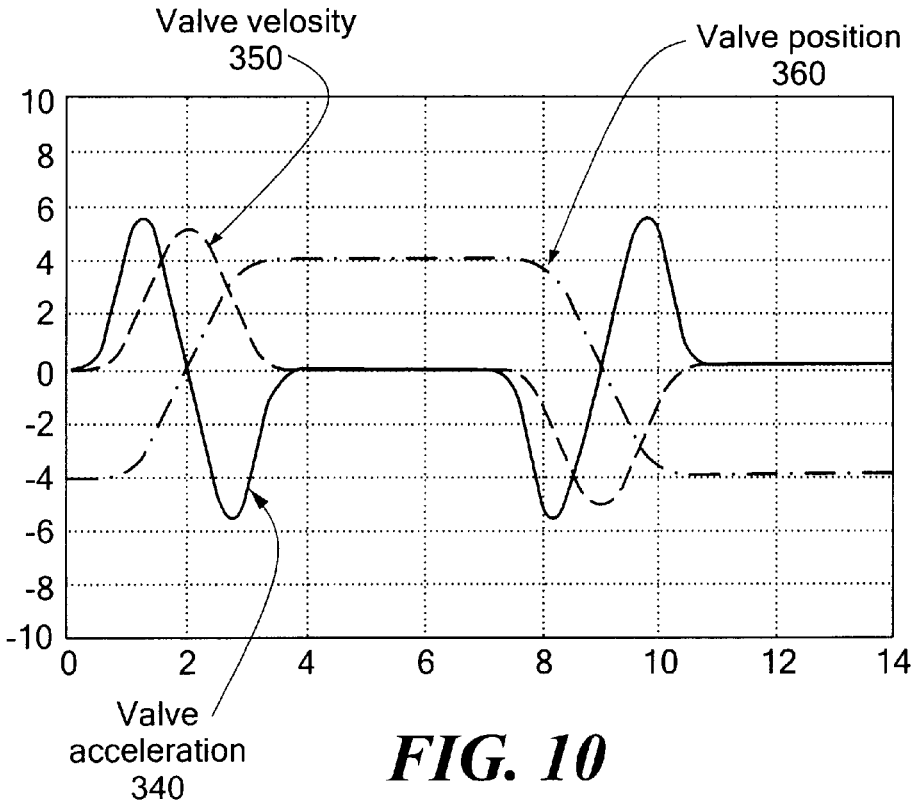
FIG. 10 is a diagram of the controlled dynamic characteristics of the present invention with feedback control.
Figure 11:
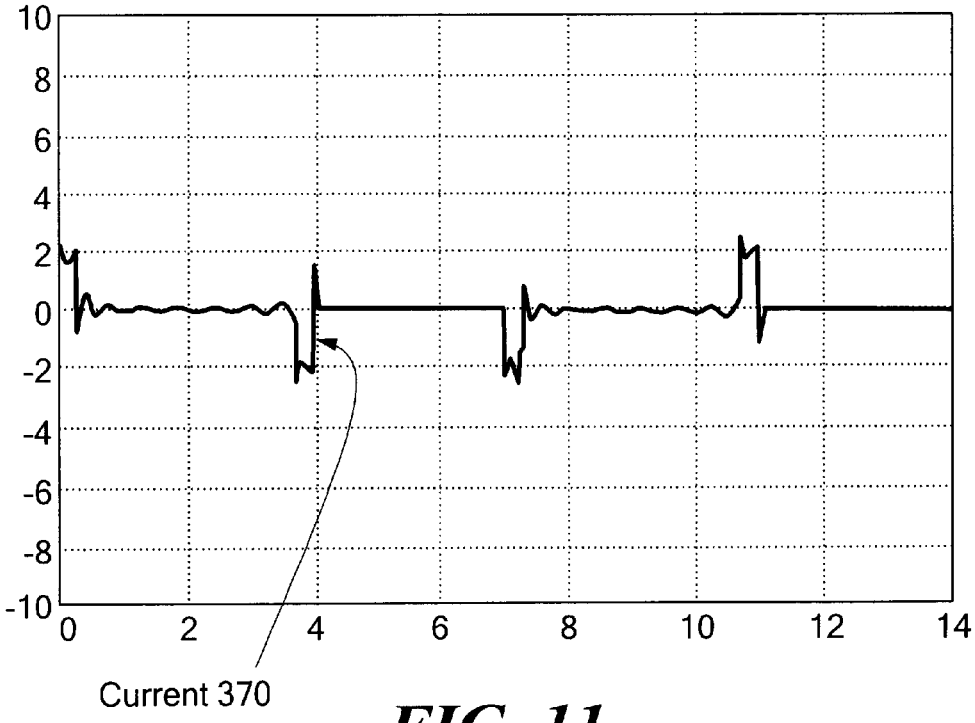
FIG. 11 is a diagram of the current associated with the characteristics of FIG. 10.

The use of the nonlinear mechanical transformer has the adverse effect of deteriorating the free flight transition time from one end of the stroke to the other end of the stroke. This is due to the acceleration at both ends of the stroke being very low. Injection of electrical currents into the motor at both ends of the stroke is used to avoid the deterioration of the free flight transition time. In order to confirm the benefits of the current injection technique, the flight dynamics in time domain of the EMVD with the nonlinear mechanical transformer, both with current injections and without current injections is shown in the curves 300, 310, 320 and 330 of FIGS. 8 and 9. Except during the current injection intervals shown in FIG. 9, the dynamic characteristics shown in FIG. 8 are undriven, or free response to a step to zero in restraining force. Also, the dynamic model relating FIGS. 8 and 9 does not include any friction, gas load, or damping terms. As can be seen from the graphs, the transition time is reduced when the current injection technique is implemented. FIGS. 10 and 11 show curves 340, 350, 360 and 370 of a simulation result for a feedback controlled EMVD with a nonlinear mechanical transformer. As shown in curve 340, the jerk is small owing to the use of the nonlinear mechanical transformer. This reduced amount of jerk is achieved with small driving and holding currents (shown in curve 370) without deteriorating the free flight transition time. This nonlinear mechanical transformer concept of the invention can be applied to not only normal force EMVD's as in prior art but also shear force EMVD's as in the embodiments illustrated here.

Figure 12:
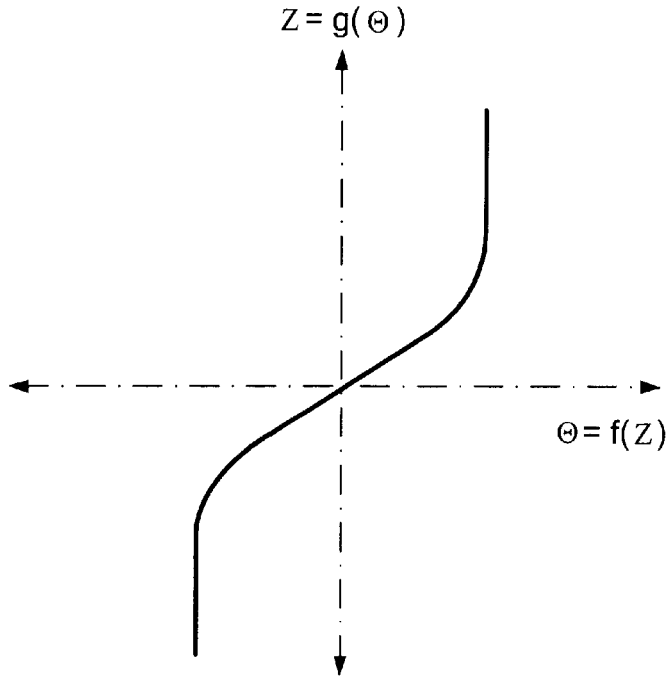
FIG. 12 is a graph showing another desired relationship between rotational displacement of the spring and translation displacement of a valve system incorporating a linear torsional spring and a linear, as opposed to rotary, shear force actuator.

FIG. 12 shows another desirable relation between the rotational displacement of a motor and the translation displacement of a valve. In this design, in order for the system to have desirable nonlinear dynamics, a linear torsional spring replaces the linear spring in FIG. 6, and the torsional spring is located to the rotary side of the nonlinear mechanical transformer instead of the valve side. Additionally the rotary motor in FIG. 6 is removed and replaced with a linear motor on the valve side of the nonlinear mechanical transformer. Since the reflected force of a torsional spring force in the motor side and valve side is small at both ends of the stroke due to the nonlinear transformer characteristic in FIG. 12, the acceleration of the EMVD incorporating this mechanical transformer is inherently smooth and small at the ends of the stroke. This is a duality version of the system in FIG. 6.

Figure 13:
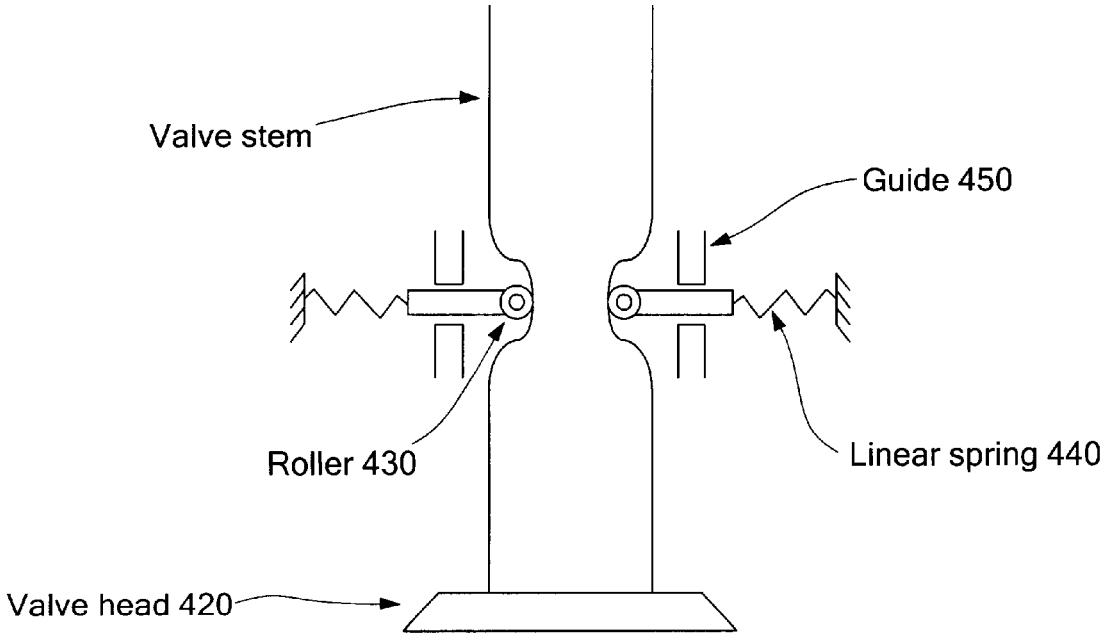
FIG. 13 is a diagram of a valve assembly utilizing a translational cam.

FIG. 13 shows another example of a nonlinear mechanical transformer 400. In this design, a translational cam is used instead of a rotary cam. The valve features a recessed portion wherein rollers 430 are provided. The rollers 430 are held in place vertically by guides 450. The rollers are biased in a horizontal direction by linear springs 440. With this mechanism, the stiffness for vertical motion of the valve 420 can also be designed with substantial flexibility.

Figure 14:
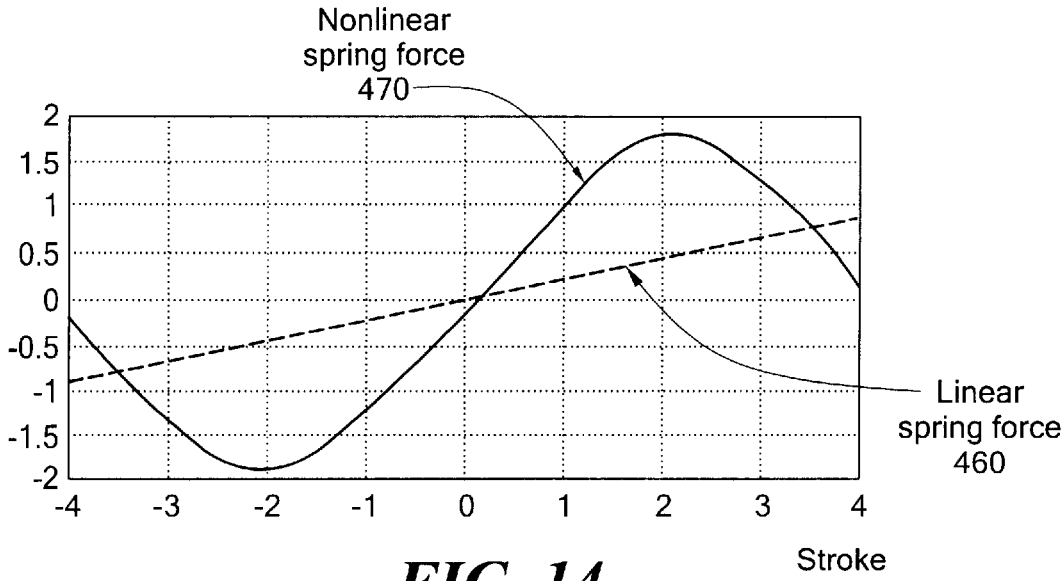
FIG. 14 is a diagram of force versus stroke for a linear spring and a desired nonlinear spring.

Referring now to FIG. 14, a force stroke curve 460 for a linear spring is shown as is a force stroke curve 470 for a nonlinear spring. Instead of a nonlinear mechanical transformer, a nonlinear spring having a force stroke curve as shown in FIG. 14 can directly be used for the same purpose of the reduction of holding and driving currents.

Figure 15:
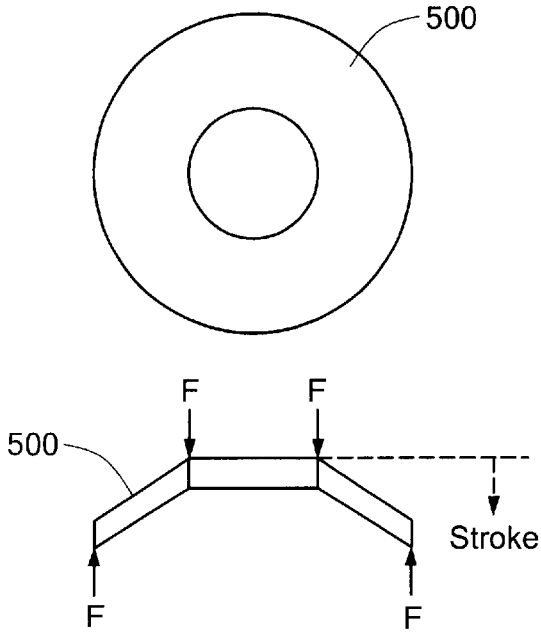
FIG. 15 is a diagram of a disk spring.
Figure 16:
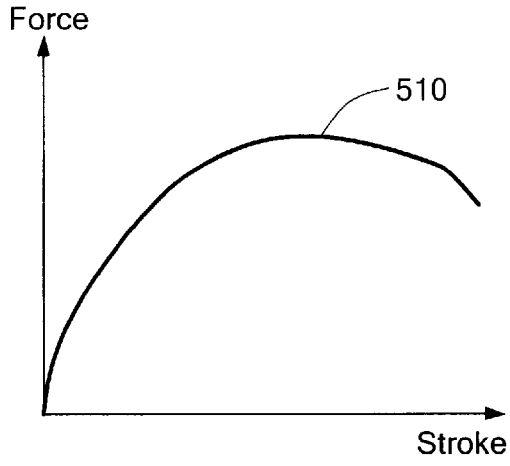
FIG. 16 is a force/stroke diagram for the disk spring of FIG. 15.

FIG. 15 shows one example of a nonlinear spring 500 having an approximately appropriate spring characteristic, a so-called disk spring. FIG. 15 shows a top and a side view of such a disk spring. FIG. 16 is the spring force stroke curve 510 of the disk spring 500. A stack of disk springs in series or parallel can be used to obtain an appropriate spring characteristic. Simple disk spring stacks have a unidirectional force versus stroke characteristic, so two stacks are required for the desired bi-directional characteristic.

Figure 17A:
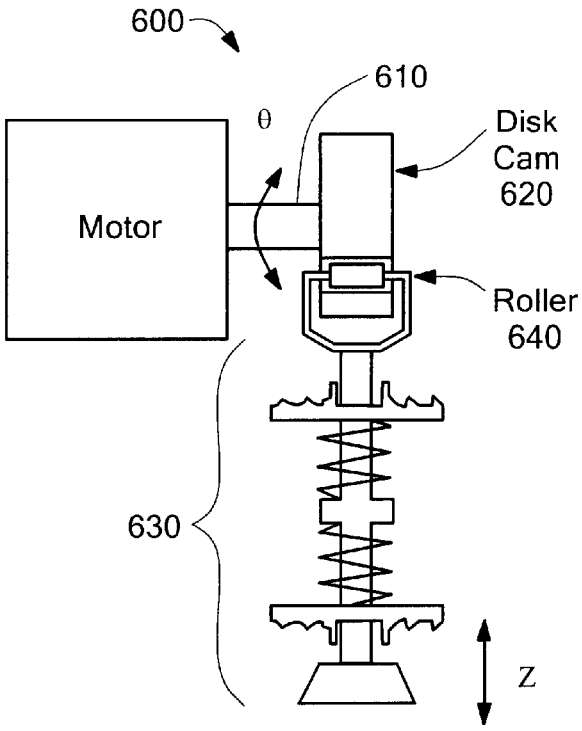
FIG. 17*a* is a diagram of a front view of a valve assembly including a disk cam.
Figure 17B:
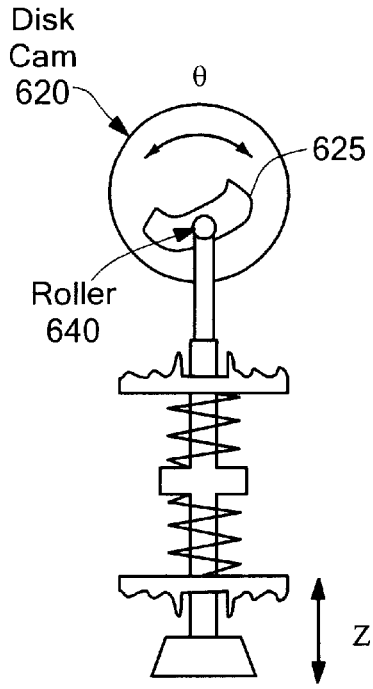
FIG. 17*b* is a diagram of a side view the valve assembly of FIG. 17*a;*
Figure 17C:
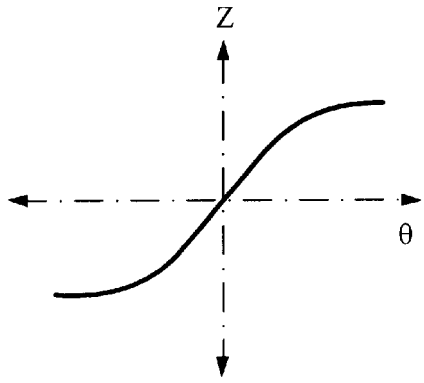
FIG. 17*c* is a diagram of displacement versus angle for the valve assembly of FIG. 17*a;*

Referring now to FIG. 17*a–b*, an embodiment 600 of a valve drive incorporating a disk cam 620 as a nonlinear mechanical transformer is shown. The motor shaft 610 is rigidly connected to the disk cam 620. The disk cam 620 has a generally circular shape and further includes a shaped slot 625. A roller 640 connected to the valve 630 rolls over either top or bottom surface of the slot of the disk cam 620. The disk cam 620 is free to rotate with the motor shaft 610. The valve 630 and roller 640 are free to move up and down along a line and constrained from other motions. This design is simple and compact, but additional power loss is expected due to the reversal of the rotational direction of the roller in the middle of the stroke. However, the loss is relatively small compared to gas power. A displacement/angle diagram for this embodiment is shown in FIG. 17*c*.

Figure 18B:
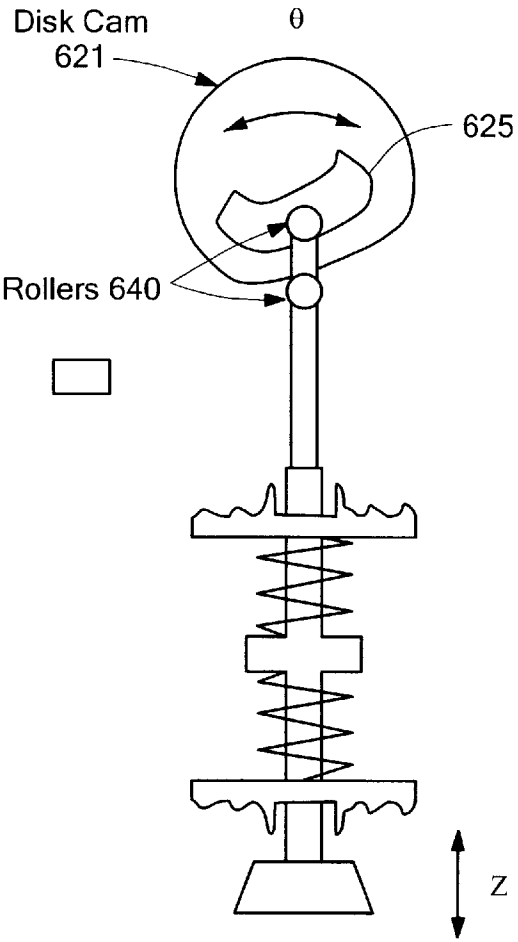
FIG. 18*b* is a diagram of a side view the valve assembly of FIG. 18*a;*
Figure 18A:
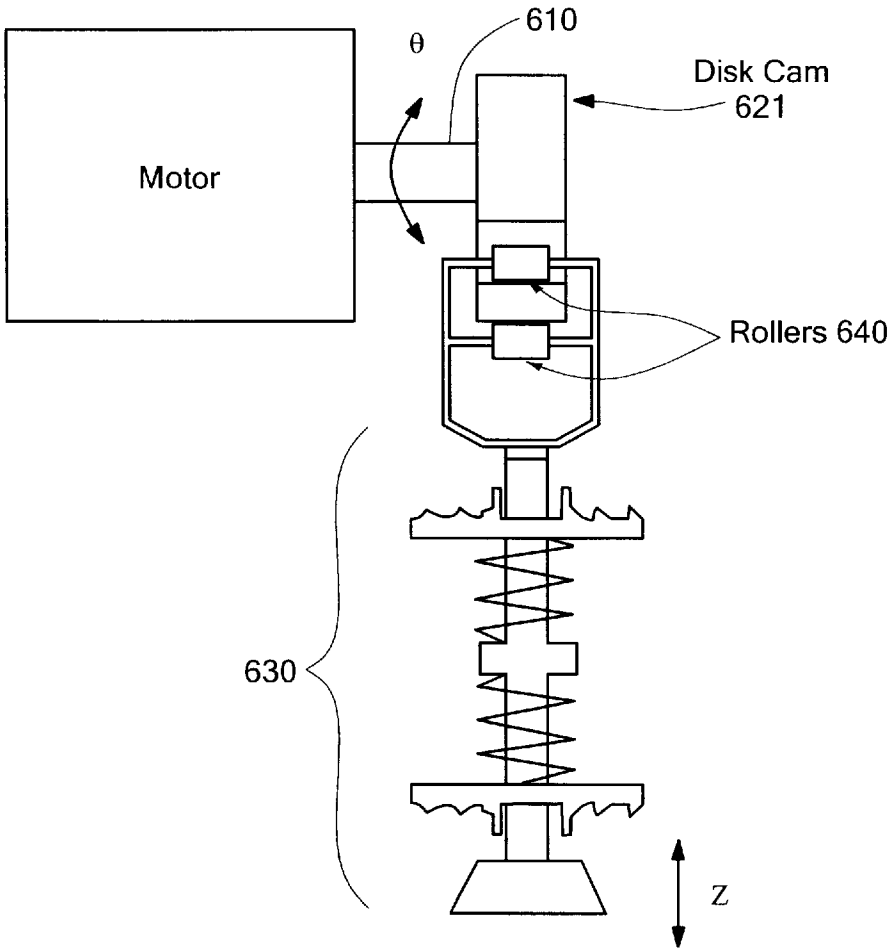
FIG. 18*a* is a diagram of a front view of a valve assembly including a second embodiment of a disk cam.

Another embodiment is shown in FIGS. 18*a–b* wherein the generally circular shaped disk cam of FIG. 17*a* is replaces with a disk cam 621 which has a flattened outside portion proximate the shaped slot 625. The conjugate disk cam of FIGS. 18*a–b* can eliminate power loss described above with respect to the embodiment utilizing the generally circular disk cam 620. A displacement/angle diagram for this embodiment is the same as shown in FIG. 17*c*.

Figure 19:
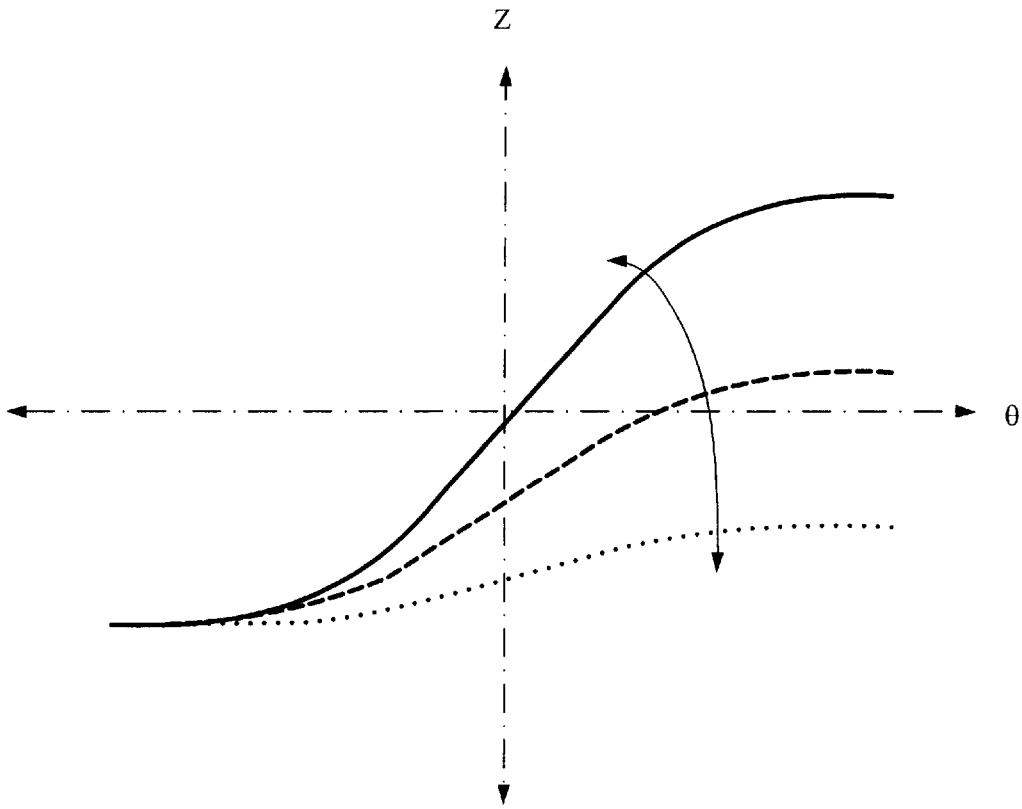
FIG. 19 is a diagram of displacement versus angle for an embodiment including multiple nonlinear mechanical transformers.

The proposed EMVD can offer a partial lift control function as well. Another nonlinear mechanical transformer plus the original nonlinear transformer can achieve this assuming that the additional nonlinear mechanical transformer controls the amplitude of the nonlinear transformer modulus as shown in FIG. 19.

Figure 20A:
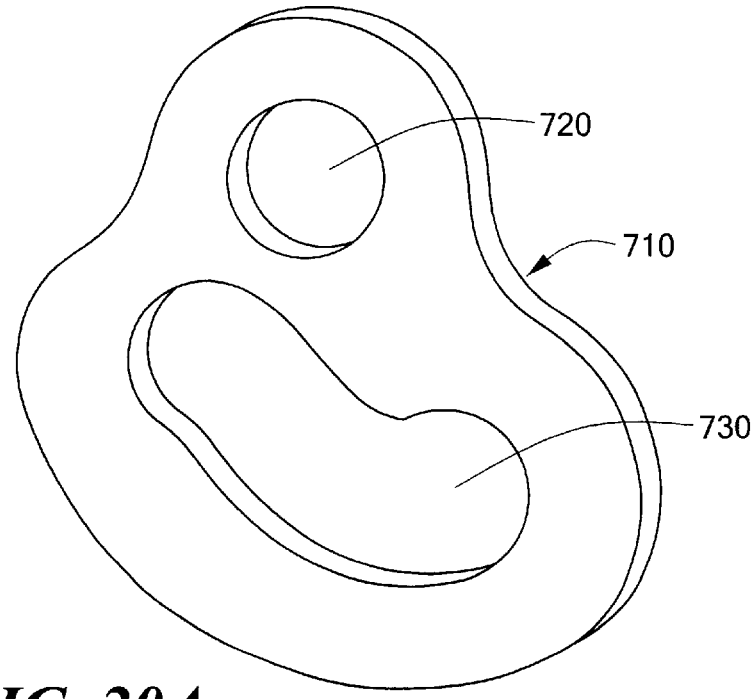
FIG. 20A is a diagram of a modified disk cam.

Referring now to FIG. 20A a disk cam incorporated in a further embodiment is shown. The disk cam 710 includes a first aperture 720 for mounting to a motor. The aperture also provides a center about which the cam rotates a predetermined portion of a revolution about the aperture. Cam 710 further includes a slot 730 in which a roller rides.

Figure 20B:
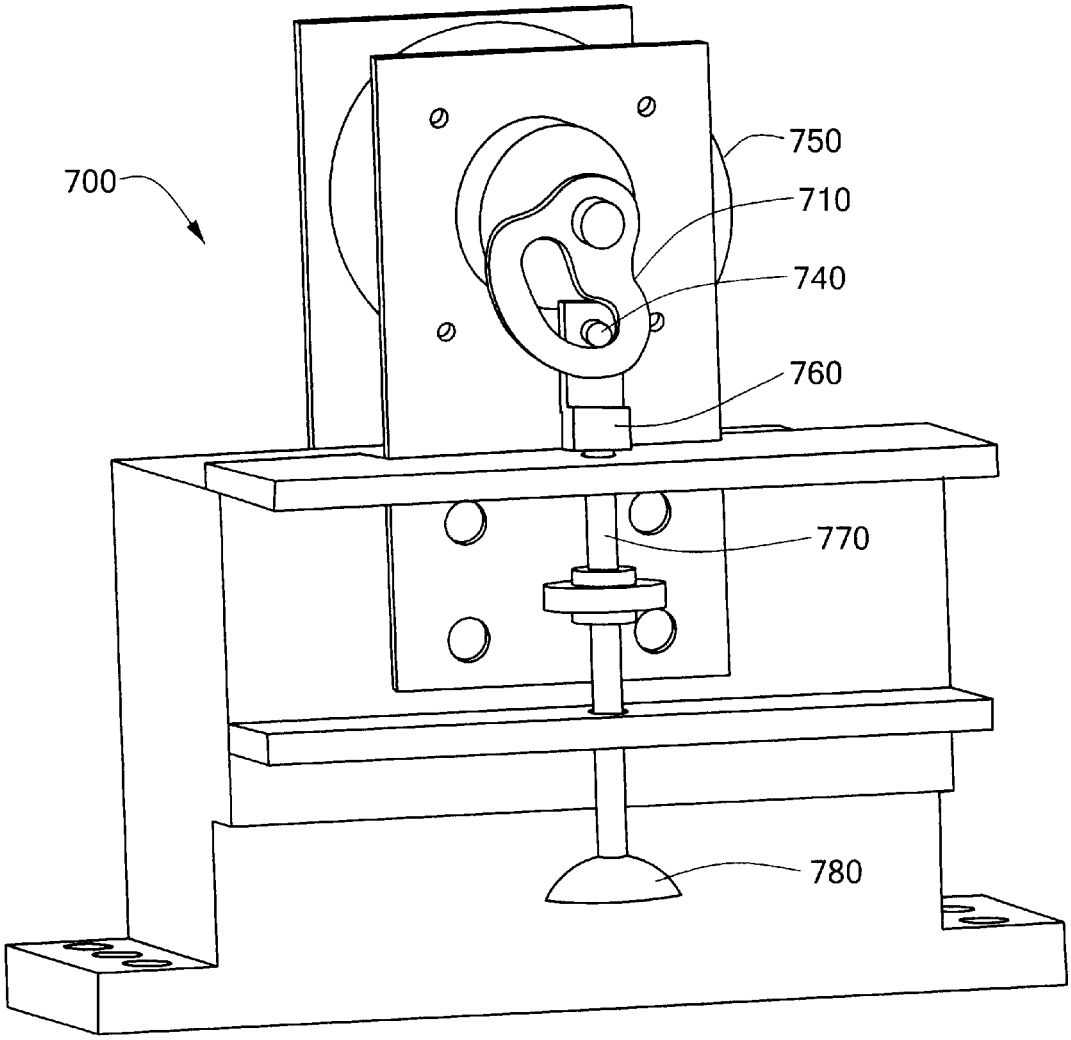
FIG. 20B is a diagram of a prototype setup including the cam of FIG. 20A.
Figure 20C:
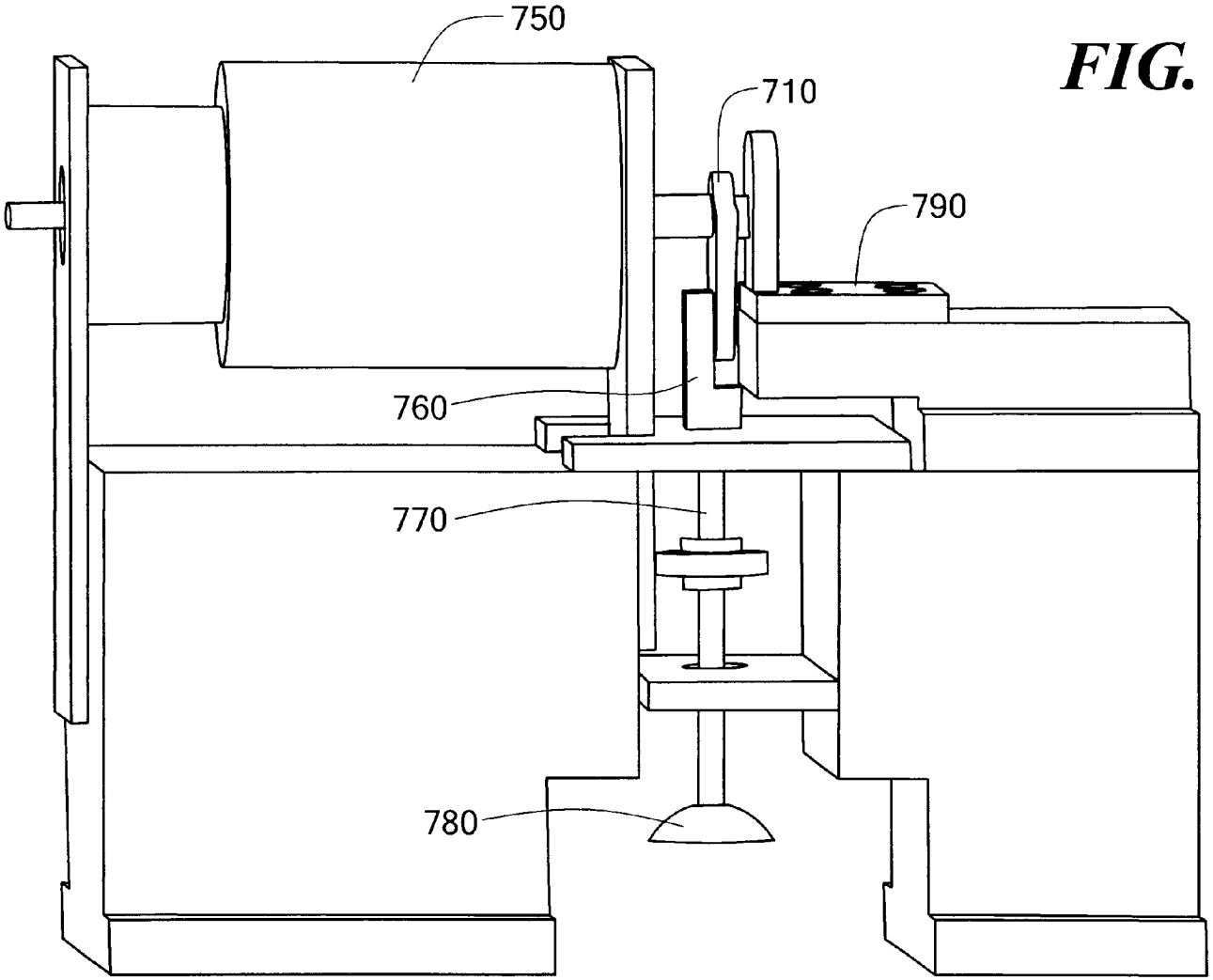
FIG. 20C is a side view of the prototype set up of FIG. 20B.
Figure 20D:
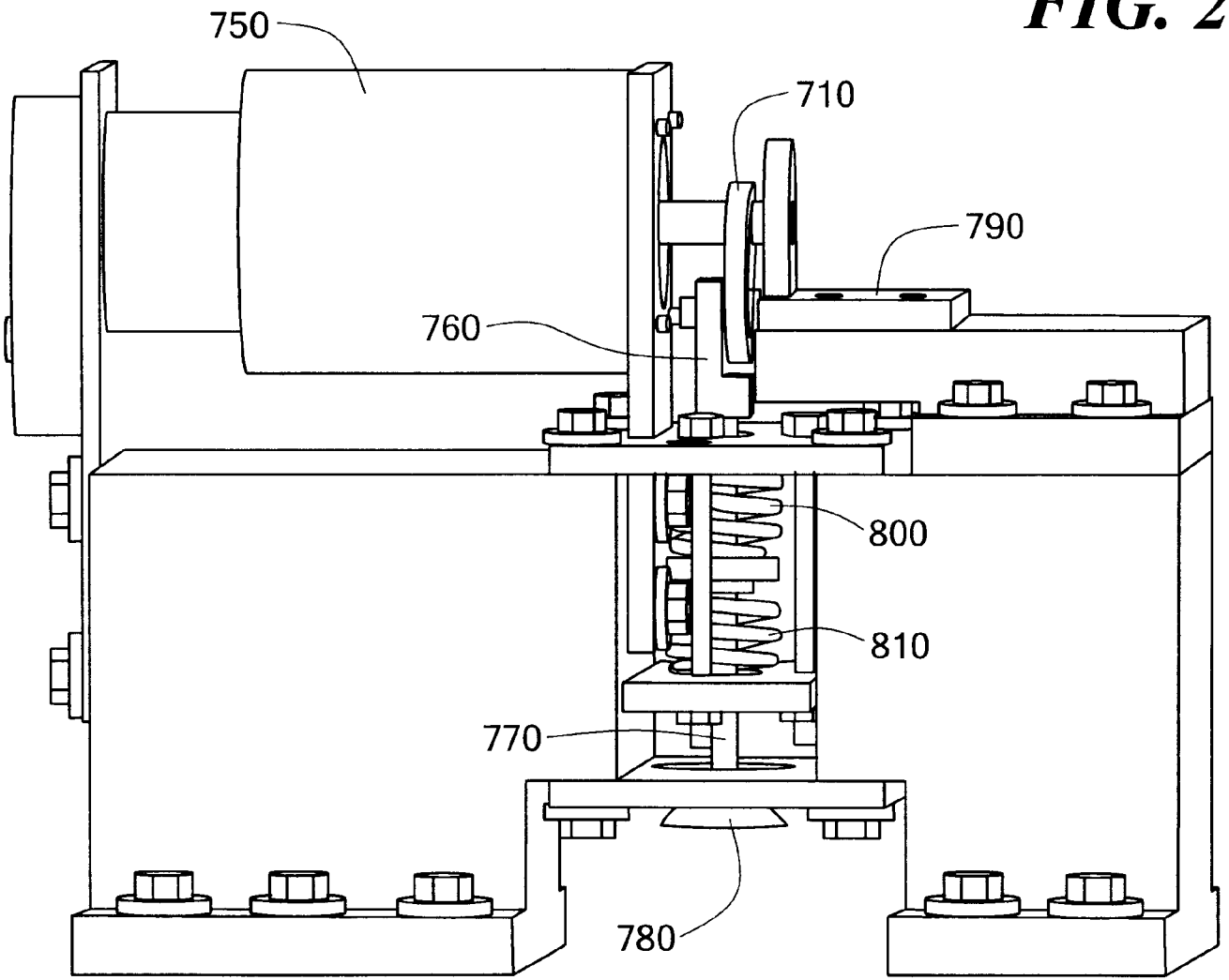
FIG. 20D is a side view of the prototype setup showing additional components.

Referring now to FIGS. 20B–D the cam is shown in a prototype test arrangement 700. Cam 710 is coupled to motor 750. Motor 750 provides left and right rotation of the disk cam, and is computer controlled. A cam follower 760 is provided with a roller 740. Roller 740 rides in slot 730 of disk cam 710. There is clearance between the roller 740 and one surface of slot 730 as the disk cam oscillates. Attached to the cam follower is a valve stem 770 and attached to valve stem 770 is valve 780. As the disk cam is cycled between clockwise and counter-clockwise rotation, roller 740 and cam follower 760 provide for generally vertical movement of valve stem 770 and valve 780. The prototype test arrangement further includes a support bearing 790 which supports the end of the motor arm on which the disk cam is attached.

For reasons of clarity, coil springs 800 and 810 are not shown in FIGS. 20B and 20C. The springs 800 and 810 are shown in FIG. 20D. The springs are shown surrounding portions of valve stem 770.

Figure 21A:
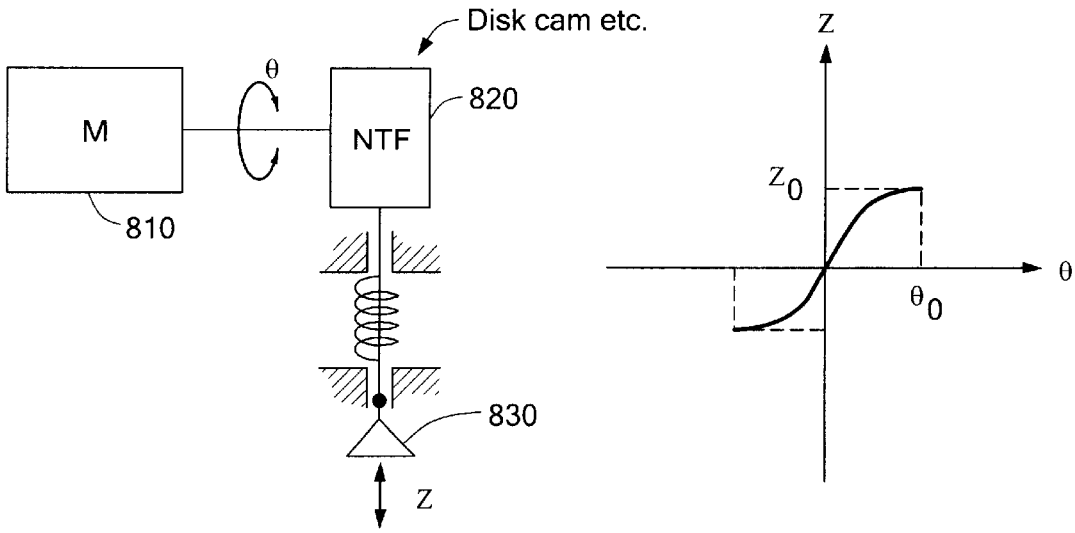
FIG. 21A is a block diagram showing the use of a single nonlinear mechanical transformer.

Referring now to FIGS. 21A–23, an embodiment which provides for partial lift control of the valve is shown. This embodiment incorporates a second nonlinear mechanical transformer, disposed between the first nonlinear mechanical transformer and the valve to provide partial lift control of the valve. As shown in FIG. 21A, and described in detail above, a motor 810 is coupled to a first nonlinear mechanical transformer 820 (e.g. a disk cam). This provides for the desired movement of the valve 830 while providing soft landing of the valve.

Figure 21B:
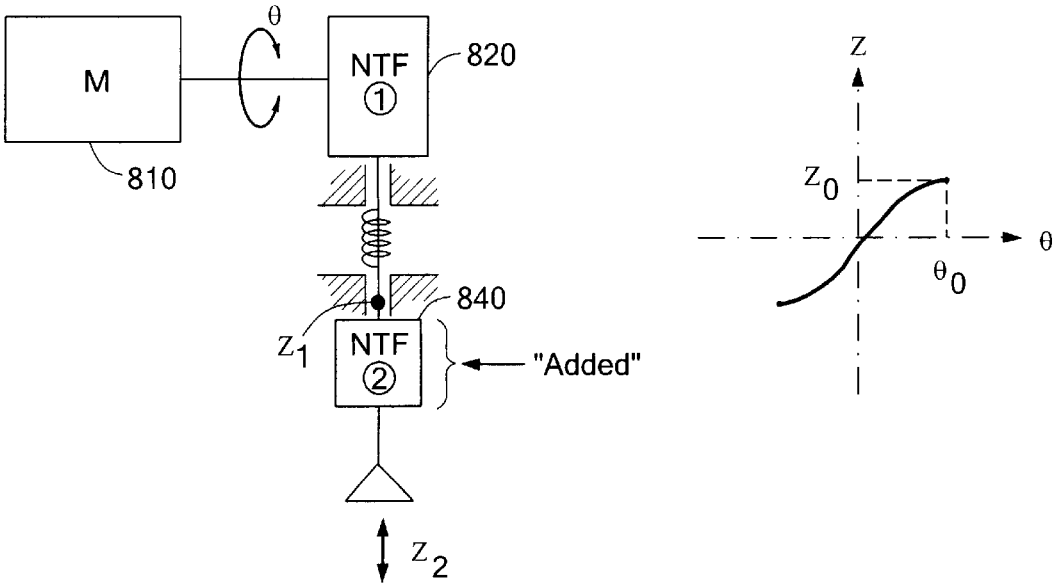
FIG. 21B is a block diagram showing an embodiment incorporating multiple nonlinear mechanical transformers to achieve partial lift control.
Figure 21C:
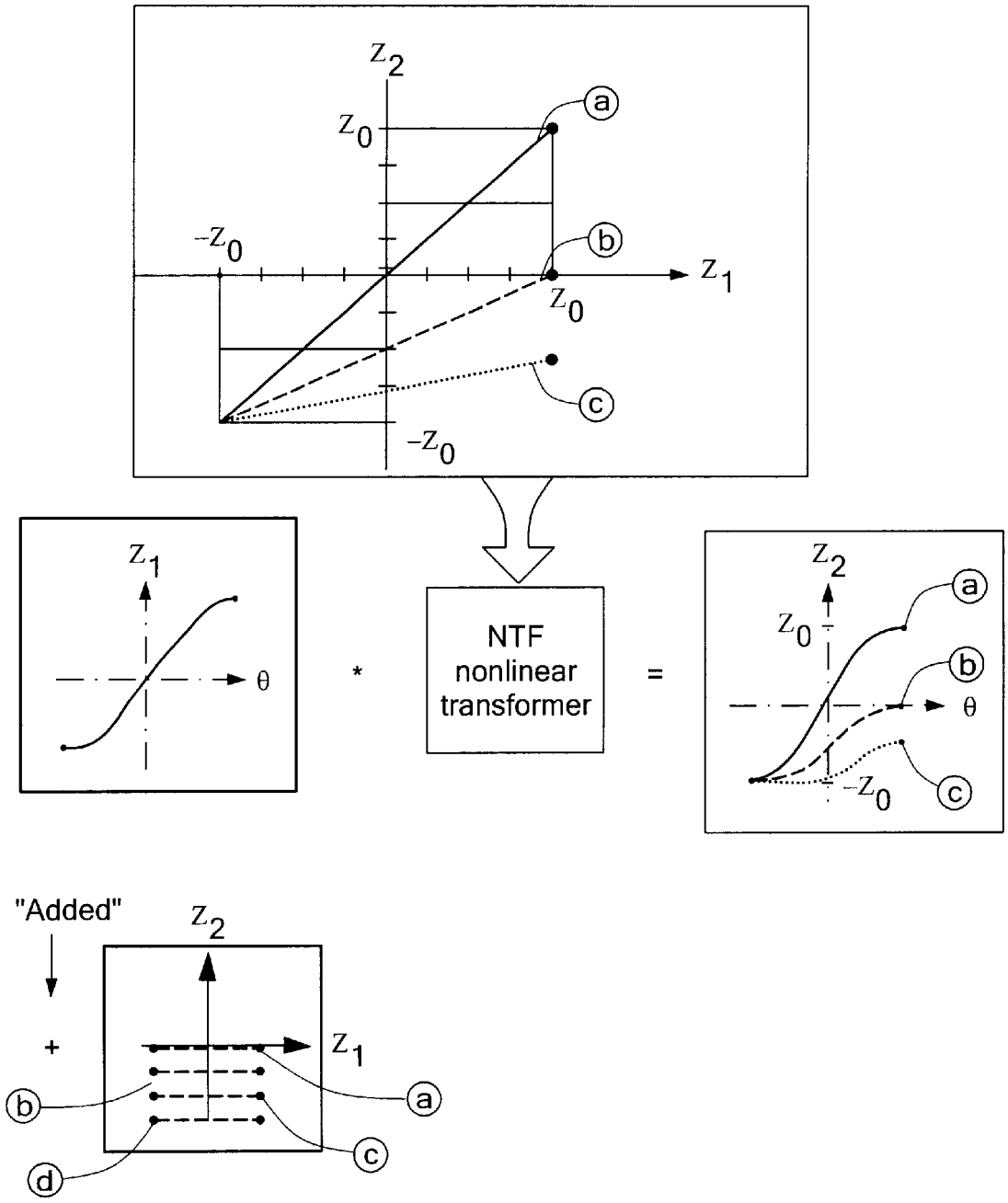
FIG. 21C is a series of graphs showing the partial lift control achieved from the first and second nonlinear mechanical transformers.
Figure 22A:
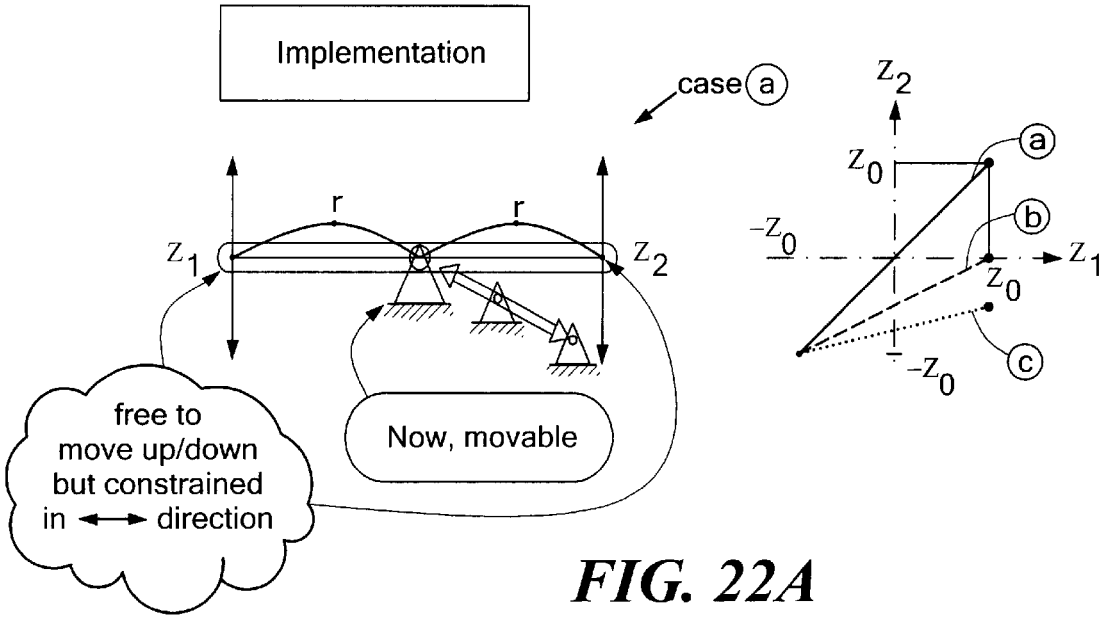
FIG. 22A is a block diagram of the second nonlinear mechanical transformer at a first setting.
Figure 22B:
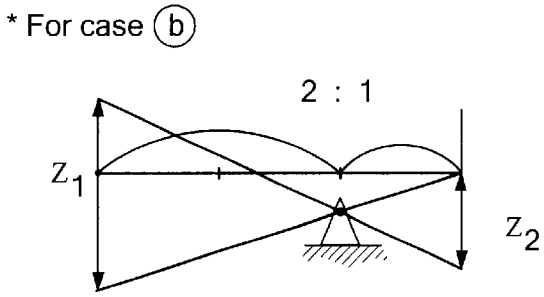
FIG. 22B is a diagram of the second nonlinear mechanical transformer at a second setting.
Figure 22C:
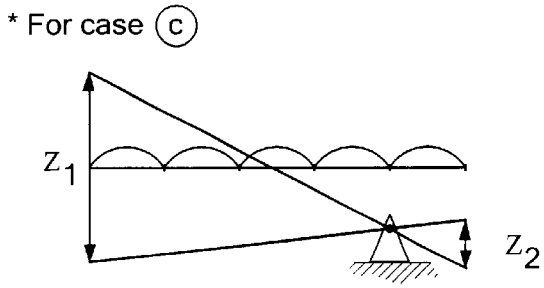
FIG. 22C is a diagram of the second nonlinear mechanical transformer at a third setting.

In order to provide the partial lift control a second nonlinear mechanical transformer 840 is attached between the first nonlinear mechanical transformer 820 and the valve 830, as shown in FIG. 21B. The utilization of the second nonlinear mechanical transformer in series with the first nonlinear mechanical transformer provides for a scaling of the translation displacement associated with the rotational displacement and also for a shifting of the mid-stroke displacement associated with the scaled translation displacement. This is shown in the diagrams of FIG. 21C and in FIGS. 22A–C.

The second nonlinear mechanical transformer has a plurality of settings which are used to provide the partial lift control function. The action of the second transformer in the illustrated embodiment is to relate $Z_1$ and $Z_2$ by $$Z_2=\alpha Z_1+\beta$$

To achieve the intended action, $\alpha$ and $\beta$ are adjusted following a fixed relationship $\beta=\alpha Z_0-Z_0$.

For each of the examples shown in FIGS. 21C and 22A–C:

at $\alpha=1$, $\beta=0$;

at $\alpha=\frac{1}{2}$, $\beta=\alpha Z_0-Z_0=-\frac{1}{2}Z_0$;

at $\beta=\frac{1}{4}$, $\beta=\alpha Z_0-Z_0=-\frac{3}{4}Z_0$; and at $\alpha=0$, $\beta=-Z_0$.

In general, for $0\leqq\alpha\leqq1$, $Z_2=\alpha Z_1+(\alpha Z_0-Z_0)$.

By way of the second mechanical transformer coupled between the first nonlinear mechanical transformer and the valve, partial lift control is provided.

Figure 23:
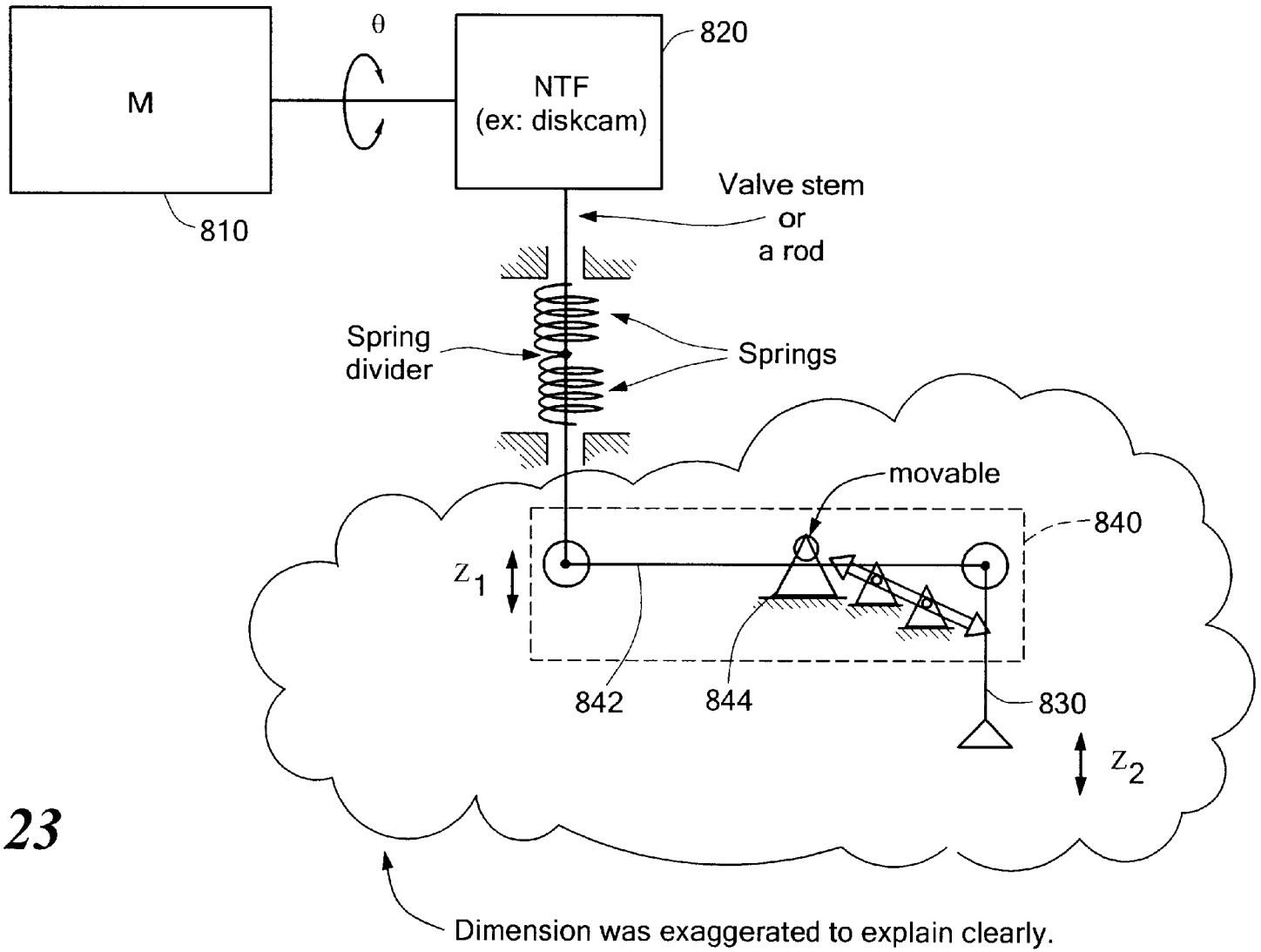
FIG. 23 is a block diagram of the system including the first and second nonlinear mechanical transformers.

Referring now to FIG. 23 a preferred embodiment of the second nonlinear mechanical transformer is shown. Other embodiments which provide a similar function may also be used to provide the partial lift control functionality. In this embodiment motor 810 drives a first nonlinear mechanical transformer 820. Coupled to the first nonlinear mechanical transformer is second nonlinear mechanical transformer 840. Second nonlinear mechanical transformer, in this embodiment, comprises an arm 842 and a movable pivot element 844. A first end of the arm 842 is coupled to the output of the first nonlinear mechanical transformer. The second end of arm 842 is coupled to valve 830. The pivot element 844 is movable in both a horizontal and vertical direction. Movement of the pivot point 844 in the horizontal direction provides for scaling of the movement of the second end of arm 842, and the valve 840. Movement of the pivot point in the vertical direction provides shifting of the movement of the second end of arm 842, and the valve 840.

The pivot element of the second nonlinear mechanical transformer may be moved dynamically, preferably during a rest period of the valve cycle. This provides for stroke-by-stroke partial lift control of the valve during operation of the valve and engine.

As discussed above the present invention incorporates a nonlinear mechanical transformer as part of an EMVD system. The nonlinear mechanical transformer is designed for the spring and the inertia in the EMVD to have desirable nonlinear characteristics. With the presently disclosed invention, the holding current and driving current are reduced. The nonlinear characteristics of a nonlinear mechanical transformer can be implemented in various ways. The invention can be extended to general servomechanical systems, in particular, systems performing reciprocating and bi-positional motion where smooth acceleration, soft landing, and low power consumption are required. The nonlinear characteristics discussed in this disclosure are provided by way of example, as the invention is intended to include other nonlinear characteristics having similar benefits.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims. All publications and references cited herein are expressly incorporated herein by reference in their entirety.

What is claimed is:

1. A valve drive assembly comprising:

a motor providing rotational displacement;

a nonlinear mechanical transformer coupled to said motor;

a valve connected to said nonlinear mechanical transformer, wherein said valve is movable by said nonlinear mechanical transformer and said motor between a first position wherein the valve is open and a second position wherein the valve is closed; and at least one spring disposed to act upon said nonlinear mechanical transformer, said at least one spring providing approximately zero pressure to said nonlinear mechanical transformer when said valve is at a position generally midway between said first position and said second position.

2. The valve drive assembly of claim 1 wherein said nonlinear mechanical transformer comprises:

a cam coupled to said motor;

a turret disposed about said cam, wherein said valve is connected to said turret; and at least one roller disposed between said cam and said turret.

3. The valve drive assembly of claim 1 further comprising at least one spring disposed between said nonlinear mechanical transformer and a frame.

4. The valve drive assembly of claim 2 wherein said cam comprises a rotary cam.

5. The valve drive assembly of claim 1 wherein current is injected into said motor at both ends of a stroke for reducing a free flight transition time of said valve.

6. The valve drive assembly of claim 1 wherein said spring comprises a linear spring.

7. A valve drive assembly comprising:

a linear motor;

a valve connected to said linear motor wherein said valve is movable by said motor between a first position wherein the valve is open and a second position wherein the valve is closed;

a nonlinear mechanical transformer coupled to said linear motor and said valve;

at least one torsional spring disposed to act upon said nonlinear mechanical transformer, said at least one torsional spring providing approximately zero pressure to said nonlinear mechanical transformer when said valve is at a position generally midway between said first position and said second position.

8. The valve drive assembly of claim 7 wherein current is injected into said motor at both ends of a stroke for reducing a free flight transition time of said valve.

9. A valve drive assembly comprising:

a motor providing rotational displacement;

a valve coupled to said motor, said valve movable between a first open position and a second closed position; and at least one nonlinear spring disposed between said valve and a support, said nonlinear spring providing approximately zero pressure to said valve when said valve is at a position generally midway between said first position and said second position.

10. The valve drive assembly of claim 9 wherein said nonlinear spring comprises at least one nonlinear disk spring.

11. A valve drive assembly comprising:

a motor providing rotational displacement;

a nonlinear mechanical transformer coupled to said motor;

a valve connected to said nonlinear mechanical transformer, wherein said valve is movable by said motor and said nonlinear mechanical transformer between a first position wherein the valve is open and a second position wherein the valve is closed; and at least one spring disposed to act upon said valve, said at least one spring providing approximately zero pressure to said valve when said valve is at a position generally midway between said first position and said second position.

12. The valve drive assembly of claim 11 wherein said nonlinear mechanical transformer comprises a disk cam, said disk cam including a slot and wherein said valve includes a roller, said roller at least partially disposed within said slot.

13. The valve drive assembly of claim 12 wherein said disk cam has a generally circular shape.

14. The valve drive assembly of claim 12 wherein a first portion of said disk cam has a generally circular shape and a second portion of said disk cam has a generally flattened shape.

15. The valve drive assembly of claim 12 wherein said disk cam has a first portion having a first curved surface, a second portion having a second curved surface and a transition portion connecting said first portion to said second portion.

16. The valve drive assembly of claim 15 wherein said second portion is larger than said first section.

17. A valve drive assembly comprising:

a motor;

a first nonlinear mechanical transformer coupled to said motor;

a coupler coupled to said first nonlinear mechanical transformer;

at least one spring disposed to act upon said coupler, said at least one spring providing approximately zero pressure to said coupler when said coupler is at a position generally midway between an uppermost position and a lowermost position;

a second nonlinear mechanical transformer coupled to said coupler;

a valve connected to said second nonlinear mechanical transformer, wherein said valve is movable by said motor, said first nonlinear mechanical transformer and said second nonlinear mechanical transformer between a first position wherein the valve is open and a second position wherein the valve is closed.

18. The valve drive assembly of claim 17 wherein said first nonlinear mechanical transformer comprises a disk cam.

19. The valve drive assembly of claim 17 wherein said second nonlinear mechanical transformer comprises:

an arm; and a pivot element coupled to said arm and wherein said arm is movable about said pivot element.

20. The valve drive assembly of claim 19 wherein said pivot element is movable in at least one direction selected from the group including a generally horizontal direction and a generally vertical direction.

* * * * *

UNITED STATES PATENT AND TRADEMARK OFFICE

CERTIFICATE OF CORRECTION

PATENT NO. : 6,755,166 B2
APPLICATION NO. : 10/245453
DATED : June 29, 2004
INVENTOR(S) : Chang et al.

It is certified that error appears in the above-identified patent and that said Letters Patent is hereby corrected as shown below:

Column 4, line 3 delete "side view the valve" and replace with --side view of the valve--.

Column 4, line 10 delete "side view the valve" and replace with --side view of the valve--.

Column 4, line 51 delete "to speed" and replace with --to the speed--.

Column 7, line 51 delete "FIG. 17a-b," and replace with --FIGS. 17a-b,--.

Column 8, lines 2-3 delete "is replaces" and replace with --is replaced--.

Column 9, line 64 delete "that that the" and replace with --that the--.

Signed and Sealed this

Fifteenth Day of January, 2008

JON W. DUDAS
*Director of the United States Patent and Trademark Office*